US006580084B1

(12) United States Patent
Hiramoto et al.

(10) Patent No.: US 6,580,084 B1
(45) Date of Patent: Jun. 17, 2003

(54) ACCELERATOR SYSTEM

(75) Inventors: Kazuo Hiramoto, Hitachiota (JP); Hiroshi Akiyama, Hitachiota (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/524,554

(22) Filed: Mar. 13, 2000

(30) Foreign Application Priority Data

Sep. 14, 1999 (JP) ..... 11-259889

(51) Int. Cl.[7] ..... H05H 9/00; H05H 13/04

(52) U.S. Cl. ..... 250/505.1; 315/503; 315/507; 315/111.61

(58) Field of Search ..... 250/505.1; 315/503, 315/507, 111.61

(56) References Cited

U.S. PATENT DOCUMENTS 4,870,287 A 9/1989 Cole et al. ..... 250/492.3

FOREIGN PATENT DOCUMENTS

JP 3-227000 10/1991
JP 5-288900 11/1993
JP 7-303710 11/1995
JP 10106800 9/1996
JP 10106800 A * 9/1996 ..... H05H/13/04

OTHER PUBLICATIONS

Proc. of the 2nd Intl. Symp. on Pet in Oncology, May 16–18, 1993, Sendai, Japan.

* cited by examiner

*Primary Examiner*—John R. Lee
*Assistant Examiner*—Nikita Wells
(74) *Attorney, Agent, or Firm*—Mattingly, Stanger & Malur, P.C.

(57) ABSTRACT

An accelerator system which can be implemented in a small size at low manufacturing cost and which can nonetheless ensure a high utilization efficiency of the ion beam. The system includes an ion source for generating an ion beam, pre-accelerators for accelerating the ion beam generated by the ion source, an radioisotope producing unit for irradiating a target with the ion beam accelerated by the pre-accelerators for producing radioisotopes, a synchrotron into which the ion beam accelerated by the pre-accelerators is injected and from which the ion beam is ejected after acceleration, and a selector electromagnet for introducing the ion beam accelerated by the pre-accelerators into either the radioisotope producing unit or the synchrotron.

4 Claims, 4 Drawing Sheets

ACCELERATOR SYSTEM

BACKGROUND OF THE INVENTION

The present invention relates to an accelerator system for accelerating an ion beam to thereby make available the beam for therapy. More particularly, the present invention is concerned with an improvement of the accelerator system such that the accelerated ion beam can be utilized for therapy with a high efficiency.

As one of the accelerator systems designed for generating an ion beam (hereinafter also referred to simply as the beam) for utilization thereof for therapy, such an accelerator system is heretofore known which is destined for use in practicing treatment of cancer by irradiating an affected part of a cancer suffering patient. A typical one of such accelerator systems is disclosed in Japanese Patent Application Laid-Open Publication No. 303710/1995 (JP-A-7-303710). More specifically, described in this publication is an accelerator system in which an ion source and a pre-accelerator(s) are put into operation in response to a trigger signal generated in dependence on movement (or positional change) of an affected part of a patient to thereby accelerate the beam for injecting it into a synchrotron in which the beam is further accelerated, whereon the affected part of the patient is irradiated with the accelerated beam outputted from the synchrotron.

Further, another type of accelerator system for generating an accelerating beam for making use of it for therapy is disclosed in "PROC. OF THE SECOND INT'1 SYMP. ON PET IN ONCOLOGY", May 16–18, 1993, Sendai Japan. Described in this publication is an accelerator system for producing an radioisotope by irradiating a target such as a nitrogen gas or the like for the purpose of utilizing it in diagnoses.

The accelerator system for the treatment of cancer and the accelerator system for producing the radioisotope mentioned above are employed for the purpose of medical treatments, and thus it is considered that both the systems may be installed in one and the same facility. In this conjunction, each of these accelerator systems is of a very large size and bulky. Consequently, installation of both the systems in one and the same facility at a same site requires a considerably large space. Consequently, there exists a demand for miniaturization of these accelerator systems. Besides, reduction of the manufacturing costs of these systems is also a matter of concern, needless to say.

Further, it is noted that in the accelerator system destined for the treatment of cancer, the beam generated by the ion source is made use of only for a short period during which the beam is injected into the synchrotron. To say in another way, during a period in which the beam is accelerated in the synchrotron and ejected therefrom, the beam being generated in the ion source is not utilized. Thus, it can be said that the accelerator system for the treatment of cancer is very poor in respect to the utilization efficiency of the ion beam.

Naturally, operations of the ion source and the pre-accelerator can be stopped during the period in which the beam acceleration and ejection or extraction is carried out in the synchrotron. In that case, however, the availability factor of the ion source and the pre-accelerator will be lowered, to a disadvantage.

SUMMARY OF THE INVENTION

In the light of the state of the art described above, it is an object of the present invention to provide an accelerator system which can be realized in a small size at low manufacturing cost and which can nonetheless ensure a high utilization efficiency of the ion beam.

In view of the above and other objects which will become apparent as the description proceeds, there is provided according to an aspect of the present invention an accelerator system which includes an ion source for generating an ion beam, a pre-accelerator for accelerating the ion beam generated by the ion source, a radioisotope producing unit for irradiating a target with the ion beam accelerated by the pre-accelerator for thereby producing a radioisotope, a synchrotron into which the ion beam accelerated by the pre-accelerator is injected and from which the ion beam is ejected after the acceleration, and a selector electromagnet for introducing the ion beam accelerated by the pre-accelerator into either the radioisotope producing unit or the synchrotron.

By virtue of the incorporation of the selector electromagnet in the accelerator system for introducing the ion beam accelerated by the pre-accelerator into either the radioisotope producing unit or the synchrotron, as described above, the ion beam generated in the ion source can be constantly and consecutively utilized by the radioisotope producing unit and the synchrotron owing to such arrangement that the ion beam is injected into the synchrotron when it is demanded while otherwise the ion beam is supplied to the radioisotope producing unit, whereby the beam utilization efficiency can be improved and enhanced significantly. In particular, owing to the arrangement that the ion source and the pre-accelerator are shared in use by the synchrotron which demands the ion beam only intermittently and the radioisotope producing unit which requires the beam continuously, the utilization efficiency of the beam can be enhanced remarkably.

Furthermore, because the ion source and the pre-accelerator are made use of as shared between the radioisotope producing unit and the synchrotron, the system as a whole can be implemented in a small size at low manufacturing cost when compared with the arrangement in which the ion source and the pre-accelerator(s) are provided separately for the radioisotope producing unit and the synchrotron, respectively.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIGS. 2A to 2F show diagrams for illustrating operation of the accelerator system, wherein FIG. 2A illustrates a waveform of a beam current generated by an ion source;

FIG. 2B illustrates a waveform of a current supplied to a selector electromagnet of the accelerator system from a power supply circuit;

FIG. 2C illustrates ion beam shots introduced into a radioisotope producing unit;

FIG. 2D illustrates timings at which a beam injection command and a beam ejection command are issued;

FIG. 2E illustrates a current of ion beam shots injected into a synchrotron through a beam injection unit; and FIG. 2F illustrates a waveform of a current supplied to a deflection electromagnet constituting a part of a synchrotron;

DESCRIPTION OF THE EMBODIMENTS

Figure 1:
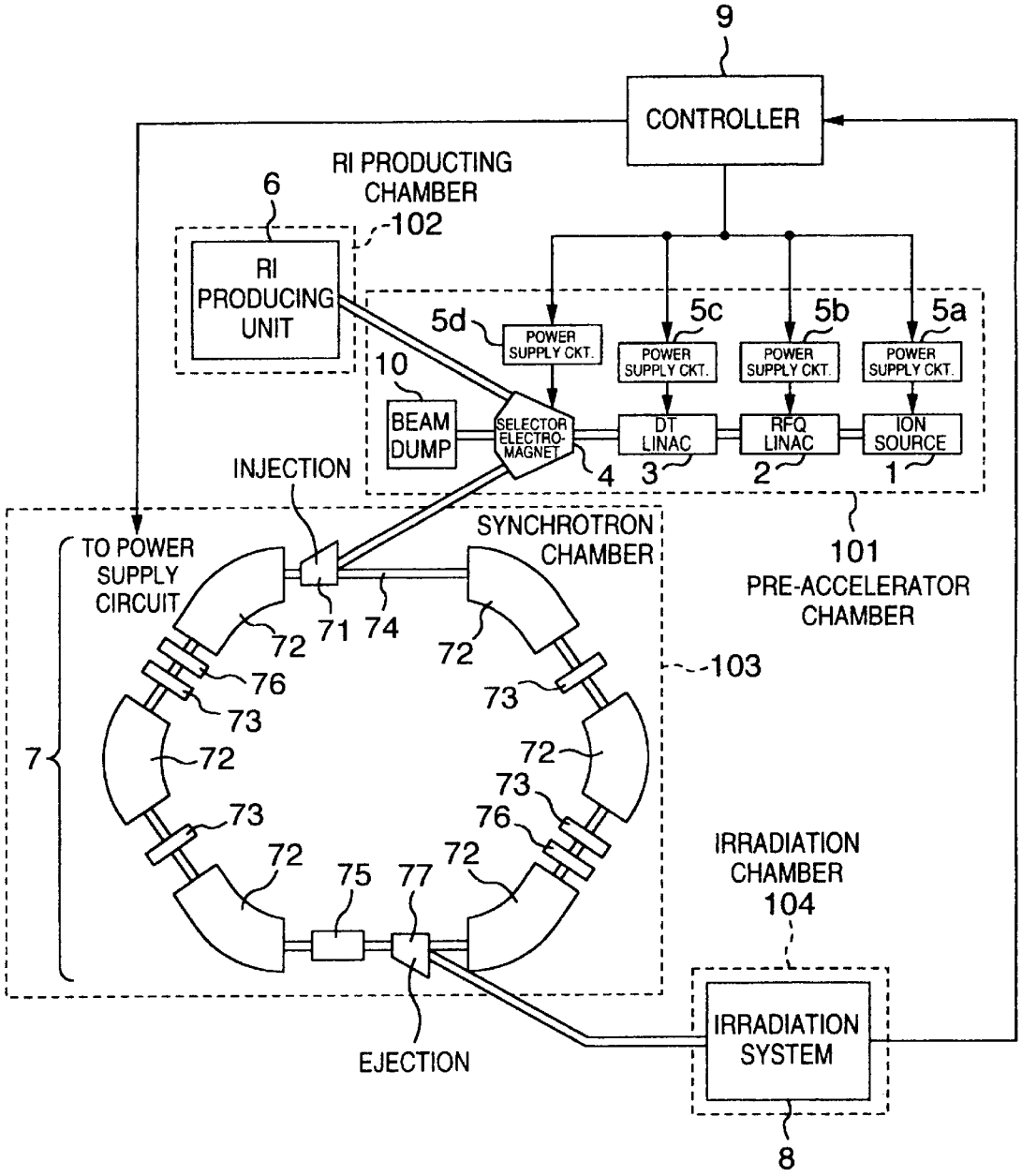
FIG. 1 is a block diagram showing generally a configuration of an accelerator system according to an embodiment of the present invention.

The present invention will be described in detail in conjunction with what is presently considered as preferred or typical embodiments thereof by reference to the drawings. In the following description, like reference characters designate like or corresponding parts throughout the several views.

FIG. 1 is a block diagram showing generally a configuration of an accelerator system according to a preferred embodiment of the present invention. As can be seen in the figure, the accelerator system according to the instant embodiment of the invention is comprised of an ion source 1 for generating an ion beam (hereinafter also referred to simply as the beam), a radio-frequency quadrupole linear accelerator or linac (hereinafter also referred to as the RFQ linac) 2 for accelerating the beam, a drift tube linac (also referred to as the DT linac) 3 serving also for accelerating the beam, a selector electromagnet 4 for adjusting selectively the beam orbit by deflecting the beam, power supply circuits 5*a*, . . . , 5*d* for supplying electric power to the ion source 1, the RFQ linac 2, the DT linac 3 and the selector electromagnet 4, respectively, a radioisotope producing unit 6 for producing radioisotope (hereinafter also referred to as RI for short), a synchrotron 7 for accelerating the beam to a given energy level for ejection, an irradiation system 8 for irradiating an affected part of a cancer suffering patient with the beam ejected from the synchrotron 7, a control apparatus or controller 9 for controlling the various components mentioned above, and others. In the case of the accelerator system according to the instant embodiment, two accelerators, i.e., the RFQ linac 2 and the DT linac 3 are employed as the pre-accelerators. To this end, however, combination of a synchrotron and an electrostatic accelerator may equally be resorted to.

Description will now be directed to the operation of the accelerator system shown in FIG. 1. At first, a value of voltage required for generating a beam in the ion source 1 is outputted from the controller 9 to the power supply circuit 5*a*. Further, voltage values or current values are outputted from the controller 9 to the power supply circuits 5*b*, 5*c* and 5*d*, respectively, simultaneously with the output of the voltage value from the controller 9 to the power supply circuit 5*a*. More specifically, a radio-frequency voltage value required for the RFQ linac 2 to accelerate the beam generated in the ion source 1 is supplied to the power supply circuit 5*b*, a radio-frequency voltage value required for the DT linac 3 to accelerate further the beam accelerated by the RFQ linac 2 is supplied to the power supply circuit 5*c*, and a current value required for the selector electromagnet 4 to introduce to the RI producing unit 6 the beam accelerated in the DT linac 3 is supplied to the power supply circuit 5*d*. These radio-frequency voltage/current values are outputted from the controller 9.

The power supply circuit 5*a* is designed to supply to the ion source 1 the voltage of the value designated or commanded by the controller 9. Upon application of the voltage, the ion source 1 generates the beam conforming to the commanded voltage value, which beam is then outputted to the RFQ linac 2. The power supply circuit 5*b* supplies to the RFQ linac 2 a radio frequency voltage of the value designated by the controller 9. In response to application of this voltage, the RFQ linac 2 accelerates the beam outputted from the ion source 1 in conformance with the radio-frequency voltage, the accelerated beam being then inputted to the DT linac 3. The power supply circuit 5*c* supplies to the DT linac 3 the radio-frequency voltage of the value commanded by the controller 9. Upon application of the radio-frequency voltage, the DT linac 3 accelerates the beam outputted from the RFQ linac 2 in conformance to the commanded voltage, the beam accelerated being then outputted to the selector electromagnet 4. On the other hand, the power supply circuit 5*d* outputs a current of the value designated by the controller 9 to the selector electromagnet 4 which responds thereto by generating the magnetic field conforming to the current command to thereby deflect correspondingly the beam outputted from the DT linac 3, whereby the beam orbit is so adjusted that the beam can be introduced into the RI producing unit 6, which in turn irradiates a target (e.g. nitrogen gas) with the beam introduced via the selector electromagnet 4 to thereby produce RI, e.g. radioisotope of nitrogen.

Figures 2A, 2B, 2C, 2D, 2E, 2F:
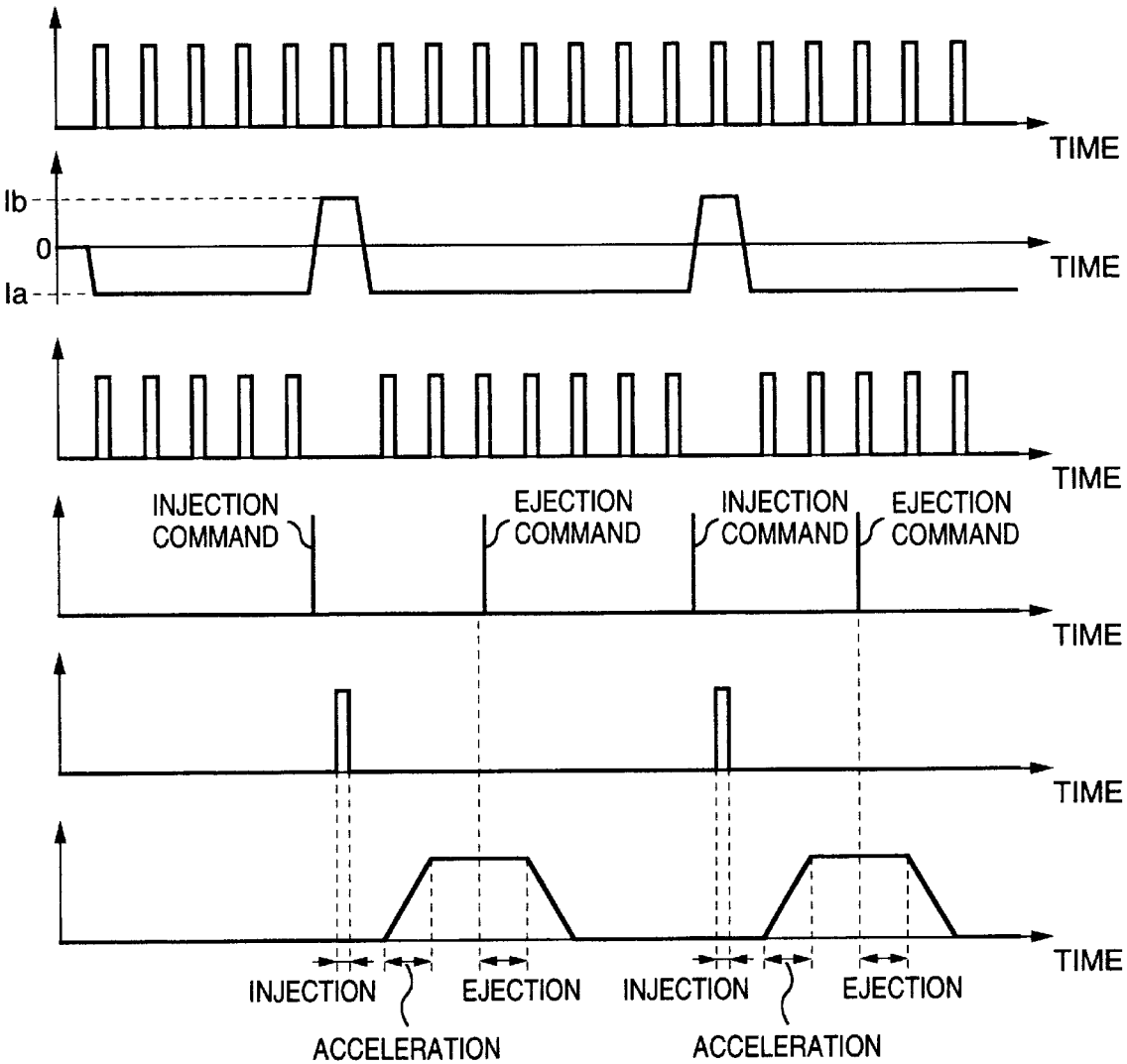

FIG. 2A shows a current value of the beam generated by the ion source 1. As can be seen from FIG. 2A, in the ion source 1, the beam is generated in the form of pulse-like beam shots, so to say, periodically at a predetermined interval. This sort of beam can be generated by designating the voltage value in a pulse-like fashion periodically at the predetermined interval to the power supply circuit 5*a* from the controller 9. Shown in FIG. 2B is a waveform of the current supplied to the selector electromagnet 4 from the power supply circuit 5*d*. For introducing the beam into the RI producing unit 6, the current of the value or level Ia is supplied to the selector electromagnet 4. Further illustrated in FIG. 2C is a current value or intensity of the beam introduced into the RI producing unit 6. It can be seen that when the current Ia shown in FIG. 2B is supplied to the selector electromagnet 4, the pulse-like beam (or a series of beam shots, so to say) is introduced into the RI producing unit 6.

Inputted to the controller 9 are an injection command and an ejection command from the irradiation system 8. In this conjunction, the method of issuing the injection command and the ejection command from the irradiation system 8 will be described hereinafter. Upon reception of the injection command such as illustrated in FIG. 2D from the irradiation system 8, the controller 9 changes the current value command issued to the power supply circuit 5*d* to the value or level Ib from the level Ia. Incidentally, the current level Ib represents the value of current required by the selector electromagnet 4 for introducing the beam into the synchrotron 7. The power supply circuit Sd responds to the current value issued from the controller 9 to thereby change the output current value to the level Ib from Ia, as is illustrated in FIG. 2B. As a result of this, the magnetic field generated by the selector electromagnet 4 changes as well, involving corresponding change of the orbit of the beam deflected under the influence of the magnetic field generated by the selector electromagnet 4. Consequently, the beam is injected into the synchrotron 7. Upon completion of introduction of the beam into the synchrotron 7, the current value issued to the power supply circuit 5*d* from the controller 9 is again changed over to the level Ia from Ib. In response, the power supply circuit 5*d* changes the output current value thereof from the level Ia to Ib, as illustrated in FIG. 2B. Thus, the beam is again introduced into the RI producing unit 6 via the selector electromagnet 4. At this juncture, it should be mentioned that the selector electromagnet 4 employed in the accelerator system according to the instant embodiment of the invention should preferably be implemented in the form of a laminated electromagnet constituted by laminating a plurality of steel sheets each of about 1 mm in thickness for realizing the selector operation mentioned above at a high speed.

The beam deflected toward the synchrotron 7 by the selector electromagnet 4 is then injected into the synchrotron 7 by means of a beam injection unit 71. In this conjunction, the current or intensity of the beam injected into the synchrotron 7 is illustrated in FIG. 2E. As can be seen from FIGS. 2B and 2E, the beam can be injected into the synchrotron 7 only when the current of the level Ib is supplied to the selector electromagnet 4. The beam injected into the synchrotron 7 is deflected under the influence of the magnetic field generated by a deflection electromagnet 72. In this way, the orbit of the beam is controlled by the deflection electromagnet 72. Further, the beam undergoes a tuning control under the magnetic fields generated by a quadrupole electromagnet 73 so that the beam can circulate or run around through a vacuum duct 74 stably. Parenthetically, the deflection electromagnet 72 and the quadrupole electromagnet 73 are provided with a power supply circuit (not shown), respectively, wherein the strength of the magnetic field generated by the electromagnet mentioned above is controlled by the current supplied from the associated power supply circuit. Of course, the currents supplied to the deflection electromagnet 72 and the quadrupole electromagnet 73 are controlled by the controller 9.

Within a radio-frequency accelerating cavity 75, a radio-frequency voltage is applied to the beam circulating through the vacuum duct 74, as a result of which energy of the beam increases. In other words, the beam is accelerated. In addition to the increase of the beam energy, the strength of the magnetic fields generated by the deflection electromagnet 72 and the quadrupole electromagnet 73 is also increased, whereby the beam can circulate or run around through the vacuum duct 74 with high stability. Referring to FIG. 2F, there is illustrated a waveform of the current supplied to the deflection electromagnet 72. As can be seen from this figure, the current supplied to the deflection electromagnet 72 is increased upon acceleration of the beam. Accordingly, the strength of the magnetic field generated by the deflection electromagnet 72 is also intensified.

When the beam energy has been increased up to the desired level within the radio-frequency accelerating cavity 75, then the beam accelerating operation is terminated. Subsequently, an ejection command is issued to the controller 9 from the irradiation system 8, as illustrated in FIG. 2D. In response thereto, the controller 9 causes a hexapole electromagnet 76 to apply a hexapole magnetic field to the beam, bringing about resonance in the beam, which results in increasing of the vibration amplitude of the beam. At this time point, the beam is ejected from the synchrotron 7 through a beam ejection unit 77. After the ejection of the beam from the synchrotron 7, the strength of the magnetic field generated by the deflection electromagnet 72 is lowered. To say in another way, deceleration is effectuated. In this conjunction, it should be added that the current supplied to the deflection electromagnet 72 is maintained to be constant during a time period from the acceleration of the beam to the ejection thereof and decreased after the beam ejection, as is illustrated in FIG. 2F. The beam ejected from the synchrotron 7 is transported to the irradiation system 8 for irradiation of an affected part of a patient with the beam. It goes without saying that during the period in which the beam is accelerated for ejection by the synchrotron 7, the ion source 1 continues to generate the beam to be supplied to the RI producing unit 6.

Figure 3:
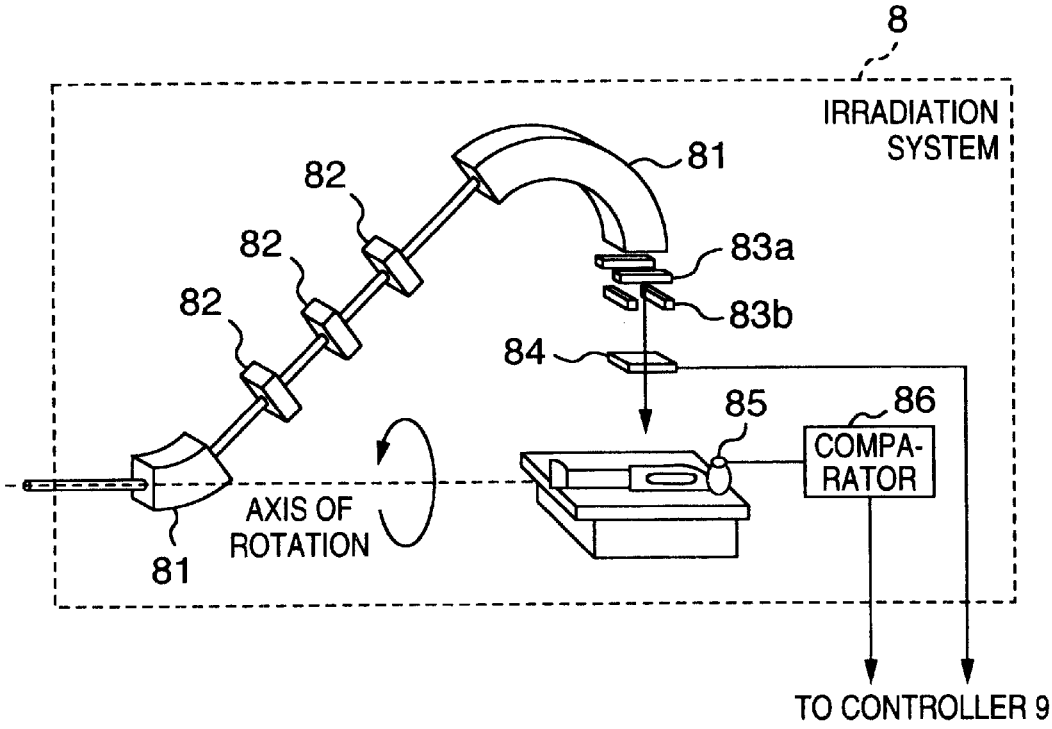
FIG. 3 is a view showing schematically a structure of an irradiation system shown in FIG. 1.

FIG. 3 is a view showing schematically a structure of the irradiation system 8. Referring to the figure, the beam ejected from the synchrotron 7 undergoes adjustment in respect to the orbit and the tuning by means of a deflection electromagnet 81 and a quadrupole electromagnet 82 of the irradiation system 8 to be subsequently transported to scanning electromagnets 83*a* and 83*b* which are provided for beam deflection and scanning. To this end, the scanning electromagnets 83*a* and 83*b* are designed to generate magnetic fields orthogonal to each other. The beam passed through the scanning electromagnets 83*a* and 83*b* is used for irradiating an affected part of a patient positioned fixedly on a treatment bed after having passed through a dose monitor 84 which is so designed as to measure the dose of the beam to thereby issue an ejection stop command to the controller 9 when the dose measured has attained a preset value of the dose. In response to the ejection stop command, the controller 9 stops the ejection of the beam. On the other hand, a flow rate monitor 85 is operatively connected to the patient for measuring the flow rate of his or her breathing or respiration. The output signal of the flow rate monitor 85 indicative of the respiration rate is inputted to a compactor 86 for which a first preset value and a second preset value are set in advance. Thus, the compactor 86 compares the inputted respiration rate with the first preset value and the second preset value, respectively. When the respiration rate reaches the first preset values, the compactor 86 issues an injection command to the controller 9 while issuing an ejection command when the respiration rate has attained the second preset value.

Figures 4A, 4B, 4C:
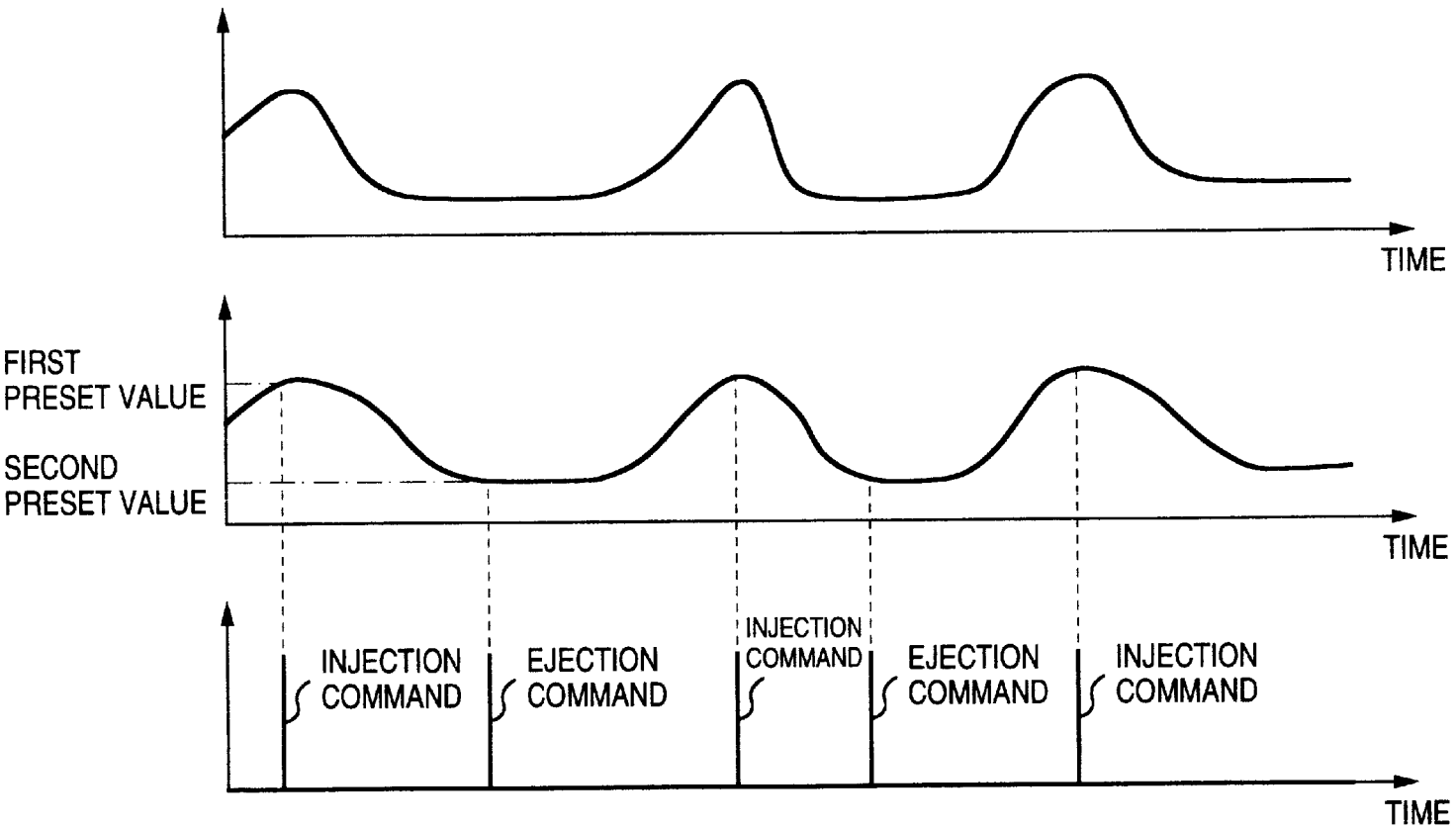
FIG. 4A is a view illustrating positional change of an affected part as a function of time lapse.
FIG. 4B is a view illustrating change of respiration flow rate of a patient as a function of time lapse.
FIG. 4C is a view showing timings at which an injection command and an ejection command are issued.

At this juncture, description will be directed to a method of setting the first preset value and the second preset value for the compactor 86 of the irradiation system 8. It is assumed, only by way of example, that the affected part of the patient is located in the vicinity of lung. Reference is made to FIGS. 4A, 4B and 4C, wherein FIG. 4A shows positional change of the affected part as a function of time lapse, FIG. 4B shows change of the respiration rate of a patient as measured by the flow rate monitor 85, and FIG. 4C shows timings at which the injection command and the ejection command are outputted, respectively. When the affected part is located closely to the lung of the patient, the position of the affected part will change in conformance to the breathing or respiration of the patient, which means that difficulty is encountered in irradiating the affected part with the beam with a desired accuracy. In this conjunction, it is noted that the position of the affected part changes substantially synchronously with the changes of the respiration flow rate of the patient and that the change of the position of the affected part becomes minimum at a local minimum value of the respiration flow rate, as can be seen in FIGS. 4A and 4B. Thus, it will be appreciated that by irradiating the affected part with the beam by ejecting it from the synchrotron 7 when the respiration flow rate assumes the local minimum value, accurate irradiation of the affected part with the beam can be accomplished, even when the position of the affected part should change. Thus, in the system according to the instant embodiment of the present invention, the local minimum value of the respiration flow rate is set as the second preset value mentioned previously, as is shown in FIG. 4B, wherein the ejection command is outputted to the controller 9 when the respiration flow rate assumes the local minimum value, as shown in FIG. 4C. Furthermore, in order to ensure that the synchrotron 7 is in the state capable of ejecting the beam when the respiration flow rate assumes the local minimum value, the local maximum value of the respiration flow rate is set as the first preset value mentioned hereinbefore, and the injection command is issued to the controller 9 when the respiration flow rate assumes the local maximum value to thereby allow the beam to be injected to the synchrotron 7.

In this way, in the accelerator system according to the instant embodiment of the invention, the amount of excitation of the selector electromagnet 4 is changed so as to allow the beam to be injected to the synchrotron 7 in response to the injection command issued to the controller 9 when the respiration flow rate of the affected part assumes the local maximum value while the synchrotron 7 can assume the state capable of ejecting the beam at the time point when the local minimum value makes appearance in the flow rate of respiration. Thus, the affected part of the patient can accurately be irradiated with the beam, to a great advantage. Although it has been mentioned that the respiration monitor for measuring the respiration flow rate is employed for detecting the positional change of the affected part in the accelerator system according to the instant embodiment, the invention is never restricted to the use of such respiration monitor. Any appropriate device capable of directly measuring the positional change of the affected part such as e.g. a distortion sensor, an image analyzer for analyzing an image of the affected part taken by a camera or the like can equally be made use of. Further, although it has been presumed in the foregoing that the affected part is located in the vicinity of the lung of the patient, it goes without saying that the system according to the present invention is effective even for the case where the affected part is located at a position remote from the lung and insusceptible to positional change or displacement. In that case, the control of the synchrotron 7 in dependence on the flow rate of respiration can simply be spared, and it is sufficient to carry out the beam ejection, acceleration and ejection periodically in a predetermined sequence.

In the accelerator system according to the instant embodiment of the invention, the ion source 1, the RFQ linac 2, the DT linac 3, the selector electromagnet 4 and the power supply circuits 5*a*, . . . , 5*d* are disposed within a pre-accelerator chamber 101, while the RI producing unit 6 is housed within an RI producing chamber 102. Further, the synchrotron 7 is accommodated within a synchrotron chamber 103 with the irradiation system 8 being disposed within an irradiation chamber 104. The pre-accelerator chamber 101, the RI producing chamber 102, the synchrotron chamber 103 and the irradiation chamber 104 are mutually radiation-shielded by shielding walls. Further, shielding shutters (not shown) are installed in the beam passage (vacuum duct) at positions between the selector electromagnet 4 and the RI producing unit 6 and between the selector electromagnet 4 and the synchrotron 7, respectively. By closing the shielding shutters, the beam (radiation lays) can be shielded. Thus, when a person has to enter the synchrotron chamber 103 for maintenance and inspection of the synchrotron 7, the beam can be so deflected as to be introduced into the RI producing unit 6 by means of the selector electromagnet 4 while the shielding shutter disposed between the selector electromagnet 4 and the synchrotron 7 is closed for shielding the synchrotron chamber 103 completely from the radiation lays so that the person can carry out his or her works with safety. On the other hand, for the maintenance/inspection of the RI producing unit 6, the beam is directed into the synchrotron 7 by means of the selector electromagnet 4 while the shielding shutter disposed between the selector electromagnet 4 and the RI producing unit 6 is closed to thereby shield the RI producing chamber 102 completely from the radiation lays. Incidentally, when maintenance for the RI producing unit 6 is being carried out and when the beam need not be injected into the synchrotron 7 (with the beam being accelerated within the synchrotron 7 or being ejected therefrom), excitation of the selector electromagnet 4 may be interrupted to allow the beam to be discarded in a beam dump 10 or alternatively beam generation by the ion source 1 may be stopped.

In the accelerator system according to the preferred embodiment of the present invention described above, the selector electromagnet 4 is provided at a stage succeeding to the DT linac 3 so that the beam can be injected into the synchrotron 7 by means of the selector electromagnet 4 when the beam is demanded by the synchrotron 7 while the beam is fed to the RI producing unit 6 by the selector electromagnet 4 when no beam is required in the synchrotron 7. By virtue of this arrangement, the beam generated by the ion source 1 can be utilized constantly and continuously by the RI producing unit 6 or the synchrotron 7, whereby the utilization ratio or efficiency of beam can significantly be enhanced, to a great advantage. In particular, owing to such arrangement that the ion source and the pre-accelerator are shared in use by the synchrotron which demands the beam intermittently and the RI producing unit which requires the beam consecutively in the system according to the embodiment of the invention described above, the utilization efficiency of the beam can be enhanced remarkably. Besides, in view of the fact that the RI producing unit demands the beam of a large current at low energy while the high-energy beam of a small current is required for the medical treatment of cancer, it is safe to say that the combination of the RI producing unit and the synchrotron for the medical treatment of cancer or the like is an optimal one.

Furthermore, because the ion source 1, the RFQ linac 2 and the DT linac 3 are made use of as being shared between the RI producing unit 6 and the synchrotron 7, the apparatus as a whole can be implemented in a small size at low manufacturing cost when compared with the arrangement in which the ion source 1, the RFQ linac 2 and the DT linac 3 are provided separately for the RI producing unit 6 and the synchrotron 7, respectively.

Although the foregoing description is directed to the accelerator system which includes the RI producing unit and the synchrotron, it should be understood that the teachings of the present invention can equally find application to such arrangement of the accelerator system that neutron producing equipment designed for use for treatment of cancer with neutrons generated by bombarding a target with an ion beam is combined with the synchrotron.

Further, by adopting such arrangement that the DT linac is disposed between the selector electromagnet 4 and the RI producing unit 6 so that the beam can further be accelerated, the species or types of the producible radioisotopes can be increased while the time taken for production of radioisotopes can be reduced.

As will now be appreciated from the foregoing, in the accelerator system according to the present invention, the ion beam generated in the ion source can constantly be utilized by the RI producing unit or the synchrotron by virtue of such arrangement that the ion beam is injected into the synchrotron when it is demanded while otherwise the ion beam is supplied to the RI producing unit, whereby the beam utilization efficiency can be improved and enhanced significantly.

Additionally, the accelerator system according to the present invention can be miniaturized and implemented inexpensively when compared with the system in which the ion sources and the pre-accelerators are provided separately for the RI producing unit and the synchrotron, respectively.

Many modifications and variations of the present invention are possible in the light of the above techniques. It is therefore to be understood that within the scope of the appended claims, the invention may be practiced otherwise than as specifically described.

What is claimed is:

1. An accelerator system, comprising:

an ion source positioned in a pre-accelerator chamber shielding radiation for generating an ion beam;

pre-accelerator positioned in said pre-accelerator chamber for accelerating the ion beam generated by said ion source;

a radioisotope producing unit positioned in a radioisotope chamber shielding the radiation for irradiating a target with the ion beam accelerated by said pre-accelerator to produce a diagnositc radioisotope;

a synchrotron positioned in a synchrotron chamber shielding the radiation, into which the ion beam accelerated by said pre-accelerator is injected and from which the ion beam is ejected after acceleration; and a selector electromagnet for introducing the ion beam accelerated by said pre-accelerator means into either said radioisotope producing unit or said synchrotron;

a first shielding shutter positioned in a first beam passage communicating between said selector electromagnet and said radioisotope producing unit;

a second shielding shutter positioned in a second beam passage communicating between said selector electromagnet and and said synchrotron; and an irradiation system positioned in an irradiation chamber shielding the radiation for irradiating an affected part of a cancer patient with the ion beam ejected from the synchrotron.

2. An accelerator system according to claim 1, further comprising:

irradiating means for irradiating a concerned part with the beam ejected from said synchrotron; and positional change detecting means for measuring change of position of said concerned part;

wherein said selector electromagnet is so designed as to inject ion beam into said synchrotron in dependence on the result of measurement performed by said positional change measuring means.

3. An accelerator system according to claim 1, wherein said selector electromagnet is laminated electromagnet constituted by laminating a plurality of steel plates.

4. An accelerator system according to claim 2, wherein said selector electromagnet is laminated electromagnet constituted by laminating a plurality of steel plates.

* * * * *